United States Patent [19]

Hüser

[11] Patent Number: 5,072,638

[45] Date of Patent: Dec. 17, 1991

[54] APPARATUS FOR SEVERING AND DEDUSTING WEBS OF PAPER OR THE LIKE

[75] Inventor: Peter Hüser, Hamburg, Fed. Rep. of Germany

[73] Assignee: E C.H. Will GmbH, Hamburg, Fed. Rep. of Germany

[21] Appl. No.: 486,514

[22] Filed: Feb. 28, 1990

[30] Foreign Application Priority Data

Mar. 1, 1989 [DE] Fed. Rep. of Germany ..... 3906376

[51] Int. Cl.[5] ..... B26D 7/18

[52] U.S. Cl. ..... 83/24; 83/99; 83/100; 83/495; 51/266; 29/DIG. 78; 29/DIG. 84

[58] Field of Search ..... 83/24, 99, 100, 156, 83/168, 495, 500, 505; 51/266; 29/DIG. 63, DIG. 78, DIG. 81, DIG.84, DIG. 94

[56] References Cited

U.S. PATENT DOCUMENTS

| | | | |
|---|---|---|---|
| 2,989,882 | 6/1961 | Remer | 83/500 X |
| 3,135,151 | 6/1964 | Link et al. | 83/168 |
| 3,272,651 | 9/1966 | Quirk | 83/100 X |
| 3,370,982 | 2/1968 | Hayunga | 83/168 X |
| 3,388,624 | 6/1968 | Baucke | 83/168 |
| 4,003,276 | 1/1977 | Schmitt | 83/100 |
| 4,201,102 | 5/1980 | Rudszinat | 83/298 |
| 4,255,998 | 3/1981 | Rudszinat | 83/298 |
| 4,300,421 | 11/1981 | Yano et al. | 83/100 X |
| 4,333,369 | 6/1982 | McCort | 83/24 |
| 4,704,930 | 11/1987 | Bödeweih | 83/24 |

*Primary Examiner*—Z. R. Bilinsky

*Attorney, Agent, or Firm*—Peter K. Kontler

[57] ABSTRACT

A web of paper, cardboard, foil or textile material is pulled against and between two rotary knives which sever the web longitudinally and form a slot as well as dust. Such dust is removed by a pneumatic mechanism having one or more nozzles which discharge one or more streams of compressed ionized air against the upper side of the web in the region of the slot, and a suction chamber disposed beneath the path for the web, extending across the slot beneath the nozzle or nozzles, and having one or more suction ports which enable the chamber to collect the particles of dust. The port or ports further enable the chamber to collect those fragments of the web which adhere to the separated sections of the web in the region of the slot between such sections.

10 Claims, 1 Drawing Sheet

APPARATUS FOR SEVERING AND DEDUSTING WEBS OF PAPER OR THE LIKE

BACKGROUND OF THE INVENTION

The invention relates to apparatus for subdividing running webs of paper, cardboard, textile material, metallic foil, plastic foil or the like. More particularly, the invention relates to improvements in apparatus which are designed to sever and simultaneously remove from running webs fragments which develop as a result of severing.

It is well known to position pneumatic dust- or fiber-expelling devices adjacent the slot which is formed by one or more rotary disc-shaped or otherwise configurated knives serving to sever the running web in the direction of its advancement toward a cross cutter or to another destination. The pneumatic devices serve to relieve the sections of a severed web of particles of web material which adhere to the sections, particularly in the region of the slot between the sections, and which also tend to adhere to the knife or knives as well as to other parts which contact the severed web. In addition, fragments of a severed web are likely to float in and contaminate the surrounding atmosphere and to ultimately gather on the floor, on the machine frame or elsewhere in the plant. Heretofore known pneumatic dust removing and collecting devices are not entirely satisfactory because a substantial percentage of fragments continues to adhere to the severed web and/or to the knife or knives and/or to the machine frame. This necessitates frequent thorough time-consuming and expensive cleaning of the knives, of the machine frame and/or of any other parts which gather fragments of severed web material. Each cleaning necessitates a prolonged stoppage of the machine with attendant losses in output, especially if the machine constitutes one unit of an entire production line, e.g., a line which serves to convert wide and very long webs into exercise pads, steno pads or other stationery products. The same holds true when a wide and long web is to be converted into stacks of paper sheets, cardboard sheets or like commodities.

It has been found that longitudinal cutters (i.e., apparatus which sever a running web longitudinally in the direction of advancement of the web) are particularly likely to generate substantial amounts of dust.

OBJECTS OF THE INVENTION

An object of the invention is to provide a novel and improved apparatus which can sever running webs of paper or the like and is also capable of gathering fragments of severed webs more effectively and more economically than heretofore known apparatus.

Another object of the invention is to provide novel and improved means for dedusting running webs of paper or the like in the region or regions where the webs are severed by pairs of rotary disc-shaped or otherwise configurated knives.

A further object of the invention is to provide an apparatus which can effectively and economically remove and collect fragments that gather on an adhere to sections of a freshly severed web in the region of the slot or slots between the sections.

An additional object of the invention is to provide the apparatus with novel and improved means for dislodging fragments which tend to adhere to the severing means and/or to the severed web and with novel and improved means for gathering and confining the thus dislodged fragments.

Another object of the invention is to reduce the tendency of the web to gather and retain fragments which develop as a result of severing of the web into two or more elongated sections.

A further object of the invention is to provide a novel and improved pneumatic dust gathering device which can be used in apparatus for severing running webs of paper or the like.

An additional object of the invention is to provide a novel and improved method of severing running webs of paper or the like and of efficiently and economically gathering fragments which develop as a result of severing of the web.

Another object of the invention is to provide a method which renders it possible to simultaneously remove dust and other impurities from both sides of a freshly severed web as well as from the severing instrumentality or instrumentalities.

A further object of the invention is to provide a novel and improved method of preventing or reducing the extent of contamination of air around the web severing station.

Another object of the invention is to provide a method which exhibits the above outlined advantages and renders it possible to eliminate, or reduce the frequency of, cleaning of the machine frame for the purpose of removing fragments of paper, cardboard or other web material which are formed as a result of severing a running web in the direction of its advancement past the severing station.

SUMMARY OF THE INVENTION

One feature of the present invention resides in the provision of an apparatus for subdividing a running web of paper or the like. The improved apparatus comprises means for advancing the web in a predetermined direction along a predetermined path, means for severing the web in a predetermined portion of the path with the resulting formation of (a) a slot or gap which extends in the predetermined direction and (b) fragments of the web, and means for removing fragments from the path including a first pneumatic removing unit at one side of the path and a second pneumatic removing unit at the other side of the path. The severing means can comprise at least one substantially disc-shaped rotary knife, and the units of the removing means are adjacent the slot in the severed web. The removing means can be disposed close to and downstream of the severing means and upstream of the advancing means (as considered in the predetermined direction). The units of the removing means preferably comprise means for removing fragments in a second direction substantially at right angles to the predetermined direction.

One of the removing units can include means for directing at least one stream or jet of gaseous fluid against the severed web in the region of the slot, and the other unit of the removing means can include at least one suction intake adjacent the slot. At least that portion of the path which is disposed between the two units is or can be substantially horizontal, and the one unit is preferably disposed above such substantially horizontal portion of the path, i.e., the other unit is then disposed beneath the substantially horizontal portion of the path. At least the other unit is preferably disposed downstream of the severing means.

The directing means of the one unit can comprise one or more nozzles which serve to discharge one or more streams or jets of compressed gaseous fluid. The other unit preferably further comprises a suction chamber which extends across a portion of the slot in the severed web and has at least one suction port which is adjacent the slot and constitutes the aforementioned suction intake. The one unit can comprise means for supplying to the nozzle or nozzles compressed air and means for ionizing compressed air not later than at the air-discharging orifice or orifices of the nozzle or nozzles.

Another feature of the invention resides in the provision of a method of subdividing and dedusting a web of paper, metallic or plastic foil, textile material, cardboard or the like. The method comprises the steps of advancing the web in a predetermined direction along a predetermined path, severing the running web with attendant formation of (a) a slot extending in the predetermined direction and (b) fragments of the web (the fragments can be in the form of dust and/or other relatively small particles of the web), and removing the fragments from the path including blowing a compressed gaseous fluid against the web in the region of the slot at one side of a portion of the path and pneumatically collecting the fragments in the region of the slot at the other side of the aforementioned portion of the path. Such portion of the path is or can be at least substantially horizontal, and the blowing step preferably includes directing at least one stream or jet of compressed air against the severed web at the upper side of the substantially horizontal portion of the path.

The method can further comprise the step of ionizing the gaseous fluid.

The advancing step can include pulling the web past at least one rotary knife which severs the web.

The at least one steam of compressed gas can be directed against the web at the one side of the path substantially or exactly at right angles to the predetermined direction.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
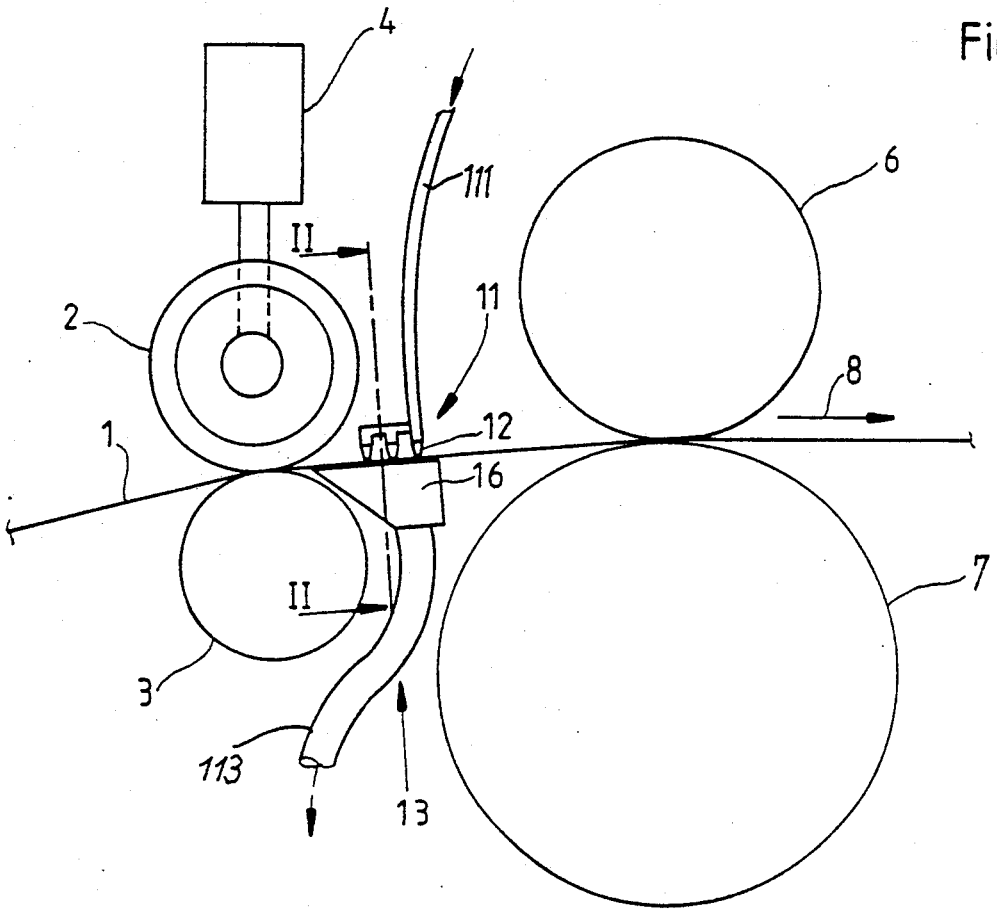
FIG. 1 is a schematic elevational view of a combined subdividing and dedusting apparatus which embodies one form of the invention.
Figure 2:
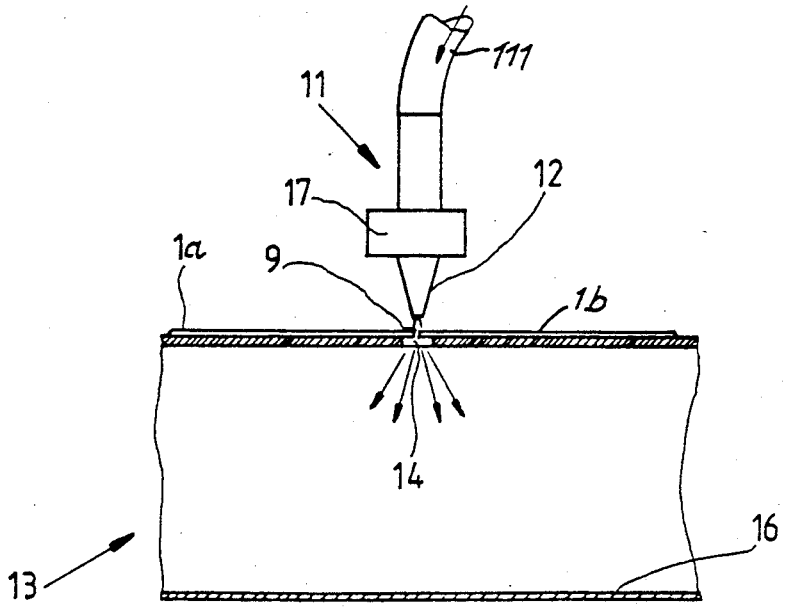
FIG. 2 is an enlarged transverse vertical sectional view substantially as seen in the direction of arrows from the line II—II of FIG. 1.

FIG. 1 shows an apparatus which can provide a running web 1 of paper, cardboard, metallic foil, plastic foil, textile material or any other suitable material with a longitudinally extending slot 9 (FIG. 2) and to thus divide the web 1 into two longitudinally extending sections 1*a* and 1*b*. The apparatus comprises a severing mechanism including an upper rotary disc-shaped knife 2 and a lower rotary disc-shaped knife or counterknife 3. The level of the upper knife 2 can be adjusted by a fluid-operated motor 4 in order to compensate for wear and/or to conform to the thickness of the web 1. The severing mechanism can be similar to or identical with those disclosed in commonly owned U.S. Pat. Nos. 4,201,102 and 4,255,998 granted to Rudszinat. The disclosures of these patents are incorporated herein by reference. The means for advancing the web 1 along its path includes two advancing rolls 6 and 7, namely an idler roll 6 above a driven roll 7 beneath the respective portion of the path for the web 1. The direction of advancement of the web I by the rolls 6, 7 (which pull the web 1 against and along the knives 2, 3) is indicated by the arrow 8.

Severing of the web 1 results in the formation of the aforementioned slot or gap 9 and in the development of dust and/or other fragments which should be collected and removed in order to avoid contamination of the machine frame, of the surrounding atmosphere, of the knives 2, 3, of the advancing rolls 6, 7 and/or of any other parts or units which are contacted by the sections 1*a*, 1*b* of the web or are adjacent the improved apparatus. In accordance with a feature of the invention, the apparatus further comprises means for removing dust and/or other particles of comminuted web (such particles will be called fragments). The removing means is preferably closely adjacent to and is located downstream of the knives 2, 3 as well as upstream of the nip of the advancing rolls 6, 7.

The illustrated removing means comprises a first removing unit 11 at a level above the adjacent horizontal or substantially horizontal portion of the path for the web 1 and sections 1*a*, 1*b*, and a second removing unit 13 at a level below such portion of the path opposite or substantially opposite the first unit 11. The first unit 11 includes one or more (e.g., three) nozzles 12 which serve to direct streams or jets of a compressed gaseous fluid (e.g., air) against the upper side of the severed web 1 in the region of the slot 9 so that the stream or streams of compressed air tend to widen the slot, to propel fragments toward the underside of the path (by way of the slot 9) and to cause separation of fragments which tend to adhere to the sections 1*a*, 1*b* in the region of the slot. The nozzles 12 receive compressed air from a suitable source (e.g., the outlet of a blower) by way of an air supplying conduit 111, and these nozzles are disposed one behind the other as seen in the direction of arrow 8.

The second unit 13 of the removing means includes a suction chamber 16 which extends transversely of the adjacent portion of the slot 9 at the underside of the path of movement of the sections 1*a*, 1*b* and has one or more ports 14 constituting suction intakes for fragments which are propelled and/or dislodged by streams of compressed air issuing from the orifices of the nozzles 12.

The orifices of the nozzles 12 are preferably oriented in such a way that they direct streams of compressed air substantially vertically, i.e., substantially at right angles to the direction of advancement of the web 1. The same applies for the direction of penetration of fragments into the suction chamber 16. As mentioned above, streams of compressed air which issue from the orifices of the nozzles 12 not only tend to widen the slot 9 but also propel fragments toward and into the suction intake or intakes 14. In addition, the streams of compressed air segregate fragments which exhibit a tendency to adhere to those marginal portions of the sections 1*a*, 1*b* which flank the slot 9. This greatly reduces the likelihood of contamination of those parts of a machine or production line which contact the sections 1*a* and 1*b* downstream of the severing station.

The removing unit 11 above the adjacent substantially horizontal portion of the path for the web 1 and its sections 1*a*, 1*b* can be equipped with one or more ion generators 17 (e.g., one ion generator for each of the three nozzles 12). Ionization of air which is being blown against the sections 1*a*, 1*b* reduces the tendency of the web 1 to become electrostatically charged and to thus attract the fragments with a greater force. It has been found that the provision of one or more ion generators of any known design contributes to the effectiveness of the improved fragment removing means.

The reference character 113 denotes a conduit which connects the outlet of the suction chamber 16 with a suction generating device, e.g., with the suction intake of the aforementioned blower.

An advantage of the feature that the unit 11 is located above and the unit 13 is located beneath the slot 9 is that the unit 13 can automatically gather those fragments which tend to descend by gravity.

The entire path for the web 1 and its sections 1*a*, 1*b* can but need not be a substantially horizontal path.

The ion generator or generators 17 constitute an optional but desirable and advantageous feature of the improved removing means. Such ion generator or generators can be put to use with particular advantage when a web of paper or other material is coated with one or more films which enhance its tendency to become electrostatically charged and to thus tend to attract and retain fragments which develop at the severing station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing a running web of paper or the like, comprising means for advancing the web in a predetermined direction along a predetermined path; means for severing the web in a predetermined portion of said path with attendant formation of a slot extending in said direction and of web fragments; and means for removing the fragments from said path, including a first pneumatic removing unit at one side and a second pneumatic removing unit at the other side of said path, said removing units including means for removing fragments in a second direction substantially transversely of said predetermined direction, the removing means of one of said units including means for directing at least one stream of gaseous fluid against the severed web in the region of the slot and the removing means of the other of said units including at least one suction intake adjacent said slot, said path being substantially horizontal in the region of said removing means, said one unit being disposed above and said other unit being disposed below said path, said directing means including at least one nozzle arranged to discharge at least one stream of compressed gaseous fluid.

2. The apparatus of claim 1, wherein said severing means comprises at least one substantially discshaped knife and said units are adjacent the slot in the severed web.

3. The apparatus of claim 1, wherein said removing means is disposed downstream or said severing means and upstream of said advancing means.

4. The apparatus of claim 1, wherein at least said other unit is disposed downstream of and close to said severing means.

5. The apparatus of claim 1, wherein said other unit further comprises a suction chamber extending transversely of the slot in the severed web and having at least one port adjacent the slot and constituting said intake.

6. The apparatus of claim 1, wherein said one unit further comprises means for supplying compressed air to said directing means and means for ionizing the compressed air.

7. A method of subdividing a web of paper or the like, comprising the steps of advancing the web in a predetermined direction along a predetermined path; severing the running web with attendant formation of a slot extending in said direction and of fragments of the web; and removing the fragments including blowing a compressed gaseous fluid against the web in the region of the slot at one side of a portion of said path, and pneumatically collecting the fragments in the region of the slot at the other side of said portion of said path, said blowing step including directing at least one stream of compressed air against the severed web at least substantially at right angles to said predetermined direction.

8. The method of claim 7, wherein said portion of said path is substantially horizontal and said blowing step includes directing at least one stream of compressed air against the severed web at the upper side of said portion of said path.

9. The method of claim 7, further comprising the step of ionizing the gaseous fluid.

10. The method of claim 7, wherein said advancing step includes pulling the web past at least one rotary knife.

* * * * *